US005196862A

United States Patent [19]

Fisher, Sr.

[11] Patent Number: 5,196,862

[45] Date of Patent: Mar. 23, 1993

[54] APPARATUS AND METHOD FOR DONOR SENSING AT THE PRINT LINE IN A THERMAL PRINTER

[75] Inventor: Terrence L. Fisher, Sr., Rochester, N.Y.

[73] Assignee: Eastman Kodak Company, Rochester, N.Y.

[21] Appl. No.: 838,014

[22] Filed: Feb. 21, 1992

[51] Int. Cl.[5] ..... B41J 2/325

[52] U.S. Cl. ..... 346/76 PH

[58] Field of Search ..... 346/76 PH, 135.1, 136; 400/120 MC, 120 MP, 237 E, 703; 271/227

[56] References Cited

U.S. PATENT DOCUMENTS

| | | | |
|---|---|---|---|
| Re. 33,260 | 7/1990 | Stephenson | 346/76 PH |
| 4,688,050 | 8/1987 | Tsao | 346/76 PH |
| 4,710,781 | 12/1987 | Stephenson | 346/76 PH |

FOREIGN PATENT DOCUMENTS

| | | | |
|---|---|---|---|
| 0154193 | 12/1980 | Japan | 400/237 E |
| 0063491 | 4/1983 | Japan | 400/703 |

*Primary Examiner*—Benjamin R. Fuller
*Assistant Examiner*—N. Le
*Attorney, Agent, or Firm*—Raymond L. Owens

[57] ABSTRACT

A thermal printer contains a thermal print head with a bead line, a print drum with surface openings, and a two-part sensor assembly with a first member mounted on the thermal print head adjacent the bead line and a second member mounted in one of the surface openings. The first and second members of the sensor assembly are alignable to communicate with one another to detect the presence of the dye donor web. Because the sensors are mounted on the print drum and mounted on or embedded in the print head at the bead line, the dye donor web is detected at the print line.

12 Claims, 2 Drawing Sheets

APPARATUS AND METHOD FOR DONOR SENSING AT THE PRINT LINE IN A THERMAL PRINTER

TECHNICAL FIELD

This invention relates generally to color thermal printers, and, more particularly, relates to mounting sensors which sense the color and position of the dye donor patches of the thermal dye transfer ribbon in the printer.

BACKGROUND OF THE INVENTION

To print effectively and efficiently using a color thermal printing process, the dye impregnated donor web must be properly positioned relative to the dye receiver. Proper positioning is required to ensure full coverage of the image area by successive color patches. A typical color donor web contains a repeating series of yellow, magenta and cyan color patches, and in some cases, a black patch and/or a clear fusing patch. Each patch must be properly aligned with the receiver to ensure high quality printing. One way to align or index the receiver and donor is by using a detector which will detect whether the color is yellow, magenta, cyan, black or clear, and identify its position.

In some donor sensing arrangements, a donor web is encoded along the edges with marks that are detected by a detecting means. The general alignment is obtained with the sensor elements placed in the donor path past the thermal print head so that the marks are detected after the donor emerges from the print head. Accordingly, it will be appreciated that it would be highly desirable to detect the markings before the donor web exits the printing area.

In other sensing arrangements, the donor web is located in a cassette with an opening therein for engagement with a sensor. The donor passes by the sensor a point that is a relatively long distance from the area where printing occurs. The color sensor senses the color of the donor as the donor is unwound from the donor supply spool before printing occurs. Understandably, much could happen between the location of the sensor and the printing location while the donor ribbon traverses this course. Accordingly, it will be appreciated that it would be highly desirable to have a color sensor to accurately sense the position and color of the donor ribbon close to the printing area for accurate registration of the colors during printing.

U.S. Pat. No. 4,710,781 which issued Dec. 1, 1987 to Stanley W. Stephenson and reissued on Jul. 10, 1990, as U.S. Pat. No. 33,260, discloses an apparatus for identifying different color frames of a donor web. A sensor includes a light emitting diode (LED) to emit red or yellow light and a corresponding photodetector to respond to the red or yellow light. A space saving arrangement positions two LEDs to illuminate the same spot on the donor web adjacent an edge of the web. The yellow and red light pass through dye frames of the moving donor web and illuminate the appropriate photodetectors. The general alignment is obtained with the sensor elements placed in the donor path past the thermal print head so that color frames are detected after the donor emerges from the print head. Where frames are detected after printing, there is an amount of each frame, equal to the length of donor between the print head and detectors, that is wasted. Accordingly, it will be appreciated that it would be highly desirable to have sensors to accurately sense the position and color of the donor web at the print line for accurate registration of the colors during printing and to thereby minimize wasted donor.

SUMMARY OF THE INVENTION

The present invention is directed to overcoming one or more of the problems set forth above. Briefly summarized, according to one aspect of the present invention, a thermal printing apparatus comprises a thermal print head having a bead line, a print drum having a surface with openings, and a two-part sensor assembly having a first member mounted on the thermal print head adjacent the bead line and a second member mounted in one of the surface openings.

The first and second members of the sensor assembly are alignable to be in communication with one another to detect the presence of the dye donor web. Because the sensors are mounted on or embedded in the print head at the bead line and the print drum, the dye donor web is detected at the print line. Detecting the dye donor web at the print line eliminates donor that would be wasted if the sensors were located remotely from the print line.

According to another aspect of the invention, a method for sensing a dye donor web in a thermal printing apparatus that has a thermal print head with a bead line and a print drum with openings comprises mounting a first member of a two-part sensor assembly on the thermal print head adjacent the bead line, mounting a second member of the two-part sensor assembly in one of the openings in the print drum, and aligning the first and second members and detecting dye donor web at the bead line as the dye donor web passes between the first and second members of the two-part sensor assembly.

These and other aspects, objects, features and advantages of the present invention will be more clearly understood and appreciated from a review of the following detailed description of the preferred embodiments and appended claims, and by reference to the accompanying drawings.

DESCRIPTION OF THE PREFERRED EMBODIMENTS

Figure 1:
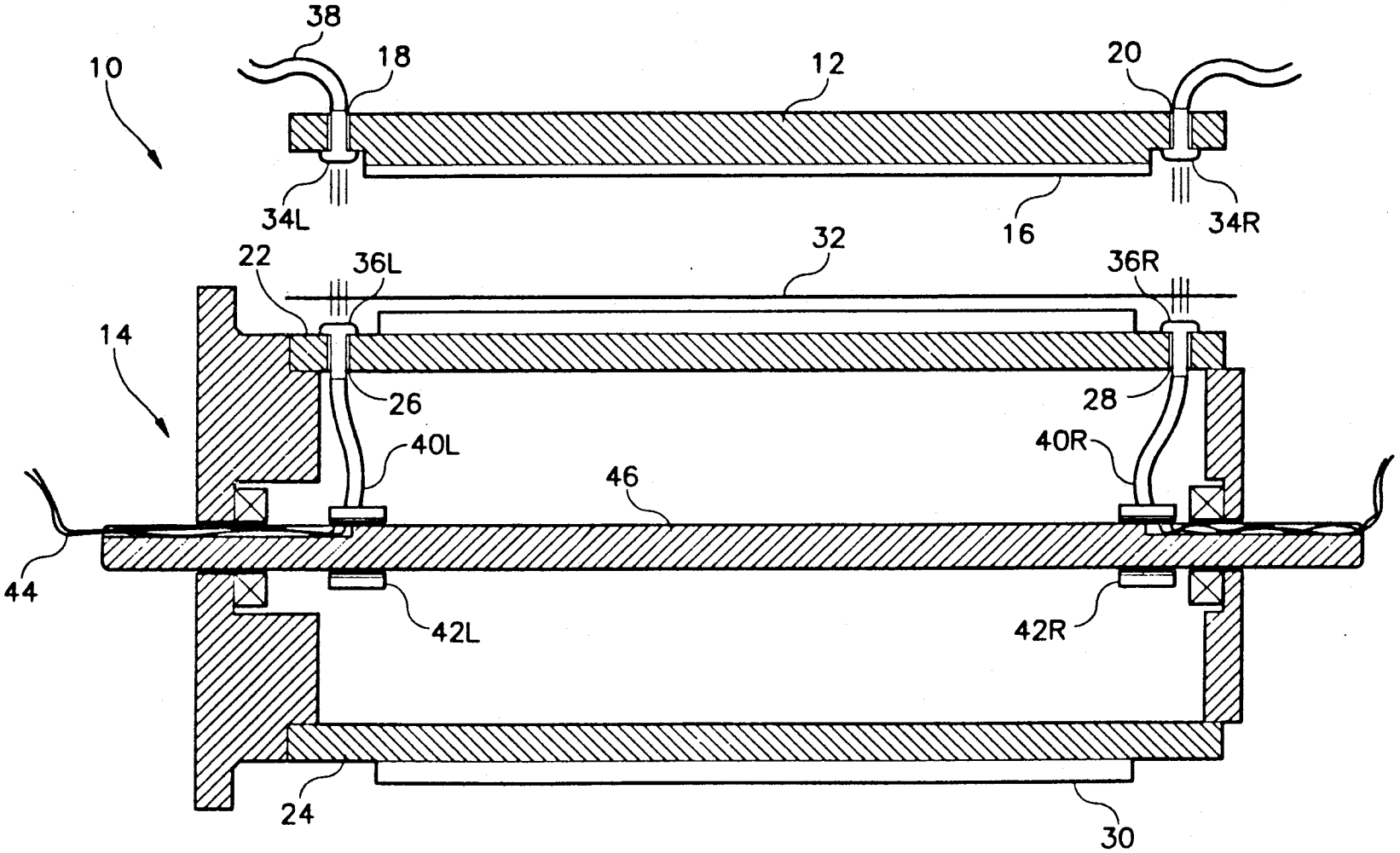
FIG. 1 is a diagrammatic cross-sectional view of a preferred embodiment of a thermal printer illustrating the print drum and print head incorporating the present invention.
Figure 2:
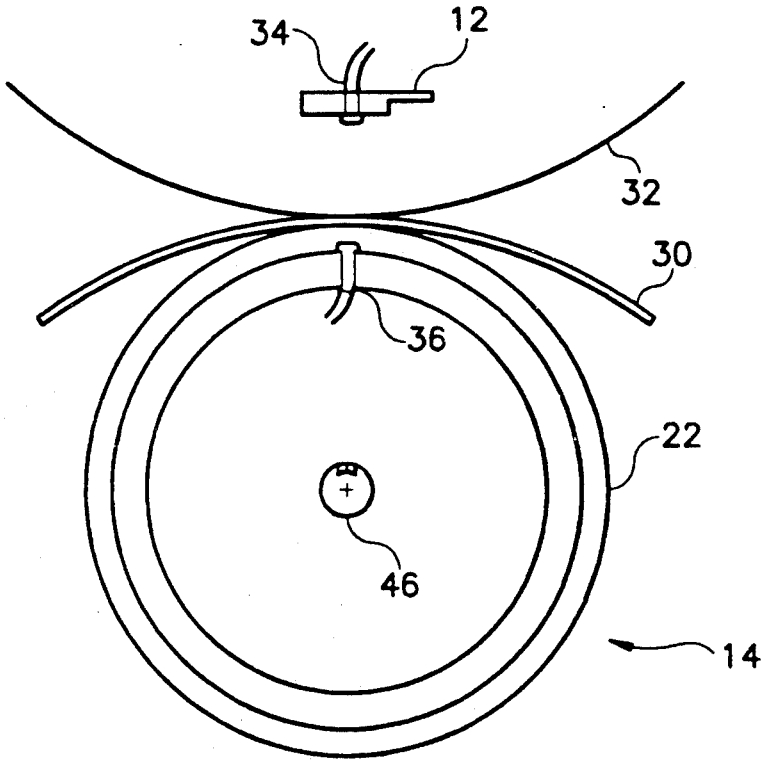
FIG. 2 is a simplified diagrammatic end view of the thermal printing apparatus of FIG. 1 illustrating the vertical alignment of the sensor assembly members.

Referring to FIGS. 1 and 2, a thermal printer 10 has a thermal print head 12 and a rotating printing drum 14. The print head 12 has a bead line 16 and first and second openings 18, 20 on either end of the print head bead line 16. The print bead 16 corresponds to the line along which the individual heating elements of the print head 12 are positioned to form a line of print. By locating the openings 18, 20 in line with the bead 16, the openings 16, 18 are always perfectly aligned with the print line. The print head 12 is movable relative to the print drum 14 between a printing position and a nonprinting position. At the nonprinting position, the thermal head 12 is spaced a first preselected distance from the print drum 14, and at the printing position, the thermal head 12 is moved closer to the print drum 14. The print drum 14 is preferably a rotating drum with a cylindrical surface 22 supported by a cylindrical body 24. The surface 22 and body 24 have a first opening 26 therein and a second opening 28 spaced from the first opening 26. The first and second openings 26, 28 are spaced far enough apart to receive a dye receiver media sheet 30 therebetween. The openings 26, 28 are close enough together so that they do not extend beyond the edges of a dye donor web 32.

A first two-part sensor assembly has a first member 34 mounted in the first opening 18 in the thermal head 12, and a second member 36 mounted in the first opening 26 of the drum 14. The sensor member 34 has an active end portion protruding out of the opening 18 in the thermal head 12 and is connected to electrical circuitry via conductors 38.

The second member 36 of the first sensor assembly has electrical leads 40 connected to a slip ring 42 which complete a circuit between the conductors 40 inside the rotating drum 14 to conductors 44 that extend outside of the rotating drum 14 to external circuitry.

The first and second members 34, 36 of the first sensor assembly are vertically aligned so that a signal may be transferred from one member, acting as an emitter, to the other member, acting as a receiver.

The slip ring 42 is fitted about the drum shaft 46 which has a longitudinal groove therein for extending the conductors 44 from outside the drum to the slip rings 42. The second sensor assembly is constructed the same as the first sensor assembly, except that it is on the other end of the drum and the other end of the head. In FIG. 1, the members on the left and right are designated with "L" and "R", respectively.

Figure 3:
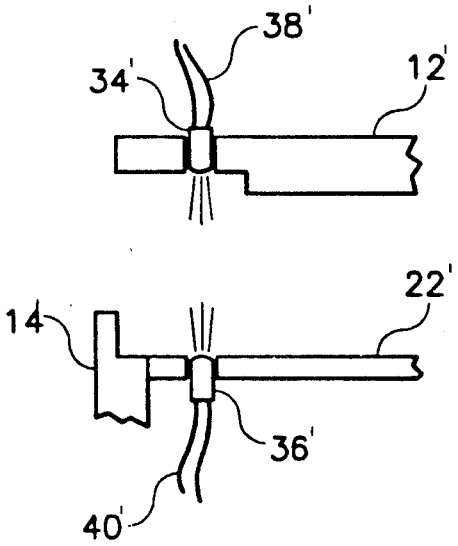
FIG. 3 is a simplified sectional view similar to FIG. 1, but illustrating another preferred embodiment.

Still referring to FIG. 1, the second sensor member 36 is shown with an active portion extending above the surface 22 of the drum 14 for communication with the active portion of the first sensor member 34. Preferably, the second sensor member 36 does not protrude above the surface 22 a distance greater than the thickness of the receiver media 30. Another embodiment is illustrate in FIG. 3 wherein the first and second sensor member 34', 36' are recessed and do not protrude out of their respective openings. Alternatively, both sensors could be flush with the tops of their respective openings, or one could be flush and the other recessed, or the one could be flush and the other protruding.

Operation of the present invention is believed to be apparent from the foregoing description and drawings, but a few words will be added for emphases. The head sensor **34*l*, 34*r* are aligned with the print bead 16 and the drum sensor members 36*l*, 36*r* are aligned so that the sensors can detect reference marks on the dye donor web 32 and detect changes in color frames on the dye donor. As the thermal head 12 moves toward the printing position, the dye donor web 32 moves toward the receiver 30 and the sensors 36** in the drum. Because the sensors do not protrude above the surface of the drum a distance greater than the thickness of the receiver, the donor web never physically contacts the sensor elements. Because the head and drum are very close together in the printing position, the detectors can very accurately detect a change in the color plane of the dye donor web. Thus, positioning the sensors inside the rotating drum allows a very accurate sensing of the color planes at the print line.

It will now be appreciated that there has been presented a thermal printing apparatus that does not waste dye donor web. The thermal printing apparatus includes a thermal print head that has a bead line and first and second openings. A print drum has a cylindrical surface with first and second openings. A first two-part sensor assembly has a first member mounted in the first head opening adjacent a first end portion of the bead line and a second member mounted in the first drum opening. A second two-part sensor assembly has a first member mounted in the second head opening adjacent a second end portion of the bead line and a second member mounted in the second drum opening. The first and second members of the first sensor assembly are alignable to be in communication with one another, and the first and second members of the second sensor assembly are alignable to be in communication with one another to thereby detect the presence of the dye donor web and different color patches thereon at the bead line.

It can also be appreciated that there has been presented a method for sensing a dye donor web in a thermal printing apparatus having a thermal print had with a bead line and a print drum with openings. The method includes mounting a first member of a two-part sensor assembly on the thermal print head adjacent the bead line, mounting a second member of the two-part sensor assembly in one of the openings in the print drum, and aligning the first and second members of the sensor assembly and detecting dye donor web at the bead line as dye donor web passes between said first and second members of the two-part sensor assembly.

While the invention has been described with particular reference to the preferred embodiments, it will be understood by those skilled in the art that various changes may be made and equivalents may be substituted for elements of the preferred embodiments without departing from the invention. In addition, many modifications may be made to adapt a particular situation and the material to a teaching of the invention without departing from the essential teachings of the invention.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and application as do not depart from the true spirit and scope of the invention.

What is claimed is:

1. A thermal printing apparatus, comprising:

a thermal print head having a bead line;

a print drum having a cylindrical surface with openings; and a two-part sensor assembly having a first member mounted on said thermal print head adjacent said bead line and a second member mounted in one of said surface openings.

2. A thermal printing apparatus, as set forth in claim 1 which uses a dye donor web, and wherein said first and second members of said sensor assembly are alignable to be in communication with one another to detect said dye donor web.

3. A thermal printing apparatus, as set forth in claim 1 which uses a dye receiver having a predetermined thickness, and wherein said second member of said sensor assembly extends from said opening above said cylindrical surface a preselected distance less than the thickness of said dye receiver.

4. A thermal printing apparatus, as set forth in claim 1, wherein said second member of said sensor assembly does not extend from said opening above said cylindrical surface.

5. A thermal printing apparatus, comprising:

a thermal print head having a bead line, having first end portion and second end portion, said print head defining first print head opening and second print head opening;

a print drum having a cylindrical surface, said print drum defining first print drum opening and second print drum opening;

a first two-part sensor assembly having a first member mounted in said first print head opening adjacent said first end portion of said bead line, and a second member mounted in said first print drum opening; and a second two-part sensor assembly having a first member mounted in said second print head opening adjacent said second end portion of said bead line, and a second member mounted in said second print drum opening.

6. A thermal printing apparatus, as set forth in claim 5 which uses a dye donor web, and wherein said first and second members of said first sensor assembly are alignable to be in communication with one another to detect said dye donor web.

7. A thermal printing apparatus, as set forth in claim 5 which uses a dye receiver having a predetermined thickness, and wherein said second member of said first sensor assembly extends from in, said second print drum opening above said cylindrical surface a preselected distance less than the thickness of said dye receiver.

8. A thermal printing apparatus, as set forth in claim 5, wherein said second member of said first sensor assembly does not extend from said second print drum opening above said cylindrical surface.

9. A thermal printing apparatus, as set forth in claim 5, wherein said second members of said first and second sensor assemblies are connected to slip rings for making electrical connections outside said print drum.

10. A thermal printing apparatus, as set forth in claim 5, which uses a dye donor web having different color patches, and wherein said first and second members of said first sensor assembly are alignable to be in communication with one another and wherein said first and second members of said second sensor assembly are alignable to be in communication with one another to thereby detect said dye donor web and different color patches thereon at said bead line.

11. A method for sensing a dye donor web in a thermal printing apparatus having a thermal print head with a bead line and a print drum with openings, comprising:

mounting a first member of a two-part sensor assembly on said thermal print head adjacent said bead line;

mounting a second member of said two-part sensor assembly in one of said openings in said print drum; and aligning said first and second members of said sensor assembly and detecting dye donor web at said bead line as said dye donor web passes between said first and second members of said two-part sensor assembly

12. A method, as set forth in claim 11, including recessing said second member of said two-part sensor assembly below a cylindrical surface of said drum.

* * * * *